US005698815A

United States Patent [19]

Ragner

[11] Patent Number: 5,698,815

[45] Date of Patent: Dec. 16, 1997

[54] STUN BULLETS

[76] Inventor: Gary Dean Ragner, 3111 SW. 34th St., Lot 70, Gainesville, Fla. 32608

[21] Appl. No.: 573,240

[22] Filed: Dec. 15, 1995

[51] Int. Cl.[6] ..... F42B 12/00

[52] U.S. Cl. ..... 102/502; 102/293; 102/501; 102/504; 102/517; 89/1.11; 361/232; 361/235

[58] Field of Search ..... 102/293, 400, 102/501, 502, 504, 512, 517, 439; 89/1.11; 361/230–233, 235

[56] References Cited

U.S. PATENT DOCUMENTS

| | | | |
|---|---|---|---|
| 2,805,067 | 9/1957 | Ryan | 273/106.5 |
| 3,209,695 | 10/1965 | Crockford et al. | 102/512 |
| 3,523,538 | 8/1970 | Shimizu | 128/404 |
| 3,626,626 | 12/1971 | Blanc | 43/6 |
| 3,732,821 | 5/1973 | Royer | 102/502 |
| 3,803,463 | 4/1974 | Cover | 361/232 |
| 4,253,132 | 2/1981 | Cover | 361/232 |
| 5,202,533 | 4/1993 | Vandersteen | 102/512 |
| 5,473,501 | 12/1995 | Claypool | 361/232 |

*Primary Examiner*—Harold J. Tudor

[57] ABSTRACT

An electronic projectile (10) for use with a standard cartridge (1). Projectile (10) and cartridge (1) are loaded into standard firearms and fired like a standard bullet. After leaving the barrel of a firearm, plastic sheaths (8L) and (8R) fall away and electrodes (19L) and (19R) extend outward on wires (40L) and (40R). On impact the electrodes penetrate the skin of the target making electrical contact with internal tissue of a target. Within projectile (10) a battery (50) powers internal electronics (30) to charge output capacitors (22) and (24) to high voltage. When the capacitors are fully charged a switch (58) completes the circuit and discharges the capacitors through the target. Switch (58) discharges the capacitors 20 to 100 times per second. These pulses continue for several seconds to incapacitate the target. The polarity of the current is changes once or twice per second to alternate between acidic and basic ions being formed around the electrodes to sterilize the puncture sight. If very-high-energy pulses are used, Switch (58) would also discharge the capacitors several seconds after the initial stun shock to defibrillate the target. Long-term incapacitation is accomplished with a syringe filled with a tranquilizing fluid (37) mounted within a foam rubber tip (34). On impact this fluid is forced into the target through needle (33), with the stun effect of the electrical discharge giving the tranquilizer time to work.

11 Claims, 7 Drawing Sheets

17L'
12L'
19L
14L'
120
12L
17L
14L
44R'
18L
16L'
40L
16L
43R'
118
43R
32
10
44R
44L
42
40R
12R
20
14R
17R
12R'
17R'
16R
14R'
44L'
8L 19R
18R
16R'

STUN BULLETS

INTRODUCTION

You are a soldier on a peace keeping mission in Bonsai. Upon entering a small village you suddenly realize something is very wrong. A dozen captured U.N. soldiers are being marched through the village by two armed men. When the men spot you they duck behind the line of POWs and draw their weapons. You already have your 9mm fully automatic weapon aimed and you fire. Two bursts of 15 rounds leave 8 men lying on the ground, including the two gunmen. Have you just killed 6 of your fellow patriots? Not if you were using "stun bullets". You have only stunned them and they will be back on their feet within a few minutes with little more than needle punctures and a bruise to remind them of the incident.

BACKGROUND

1. Field of Invention

This invention relates to personal protection devices and more specifically to non-lethal electronic ballistic weapons for use on biological targets.

2. Description of Prior Art

The need for non-lethal weapons have been brought to the forefront of the news by recent events. At present, military forces must resort to lethal weapons to protect themselves because effective non-lethal weapons do not exist. Law enforcement officers also need an effective non-lethal way to subdue a suspect. At present, officers must tackle a suspect to stop him, or hit them with a baton to subdue them. Both of these methods can cause serious injury to the suspect and the officer. Therefore, there is a great need for a system that would operate with great speed and precision like a firearm, but would only stun the target instead of kill them. The proprietary stun bullet disclosed in this patent application will satisfy this need for a highly effective non-lethal weapon.

A number of studies have been done to determine the effects of electrical shock on biological targets. There exists four basic magnitudes of electric shock. The first is just an annoyance, causing muscle contractions, and discomfort, but voluntary motor control is still functioning. The second, is just above "let-go" current, that is, a current sufficient that voluntary muscular control is lost or cannot overcome contractions created by the current. The third stage is where fibrillation of the heart occurs. Currents, and durations at this level can cause the heart muscles to go into uncontrolled spasm, and thus stop the flow of blood to the persons organs. Death quickly follows. This third stage involves small currents and produces little physical damage to organs, and tissue. Death is a result of the heart going into spasm. The forth stage is where extremely high currents are involved and actual physical damage is done to tissue, that is, burns, heating, and etc. Death usually results immediately if medical attention is not applied quickly. Death can result much later at this level due to burns and internal damage.

The last three stages are all potentially lethal. For currents just above "let-go" asphyxiation is usually the cause of death because the person cannot control their muscles to take a breath. For higher currents fibrillation can occur within seconds and death results.

The McGraw-Hill SCIENCE AND TECHNOLOGY ENCYCLOPEDIA define the maximum tolerable electric shock exposure in terms of the length of time in seconds of the exposure.

$$\text{Maximum current} = \frac{0.116 \text{ ampere}}{\sqrt{\text{time}}} \quad \text{Eq. 1}$$

$$\text{Maximum Voltage} = \frac{116 \text{ volts}}{\sqrt{\text{time}}} \quad \text{Eq. 2}$$

Equation 2 assumes a 1000 ohms electrical resistance for the body (not necessarily a good assumption). This is the assumed minimum resistance and represents an average bodies electrical resistance through the skin. These equations give maximum values which will not cause heart fibrillation in even the most susceptible. Thus, the equations give values just below the onset of a stage three shock, heart fibrillation. Notice that in Equation 1 the maximum current gets smaller as the exposure time lengthens. This shows how the effects of electric shock are accumulative, and accumulative through a square root relationship.

In IEEE SPECTRUM February 1969, p. 44, Charles F. Danliel discusses the relationship between body weight, and fibrillation current. He found a nearly linear relationship between fibrillation current, and body weight. Thus, a larger person can proportionally withstand more current than a smaller person. This data implies the "current density" for fibrillation is nearly the same for many animals. From this data we can predict that a maximum non-fibrillating current for a 80 Kg(176lb.) person would be around 100 milliamperes for a 3 second shock. Notice that this is slightly above the tolerable current predicted in Equation 1 for a 3 second shock. This is because people with smaller body weights must be taken into account. Thus, for a three second shock 67 milliamperes is the maximum safe exposure for adults. For a 10 second exposure only 37 milliamperes is acceptable. This represents a maximum non-lethal current for a safe shocking device that can not cause fibrillation. It should also be noted that all these values are for currents that pass through the chest cavity, and thus the heart. If the heart is not within the circuit, much larger currents and time periods are not lethal.

It has also been found in recent years that the stun effect from low current levels can be enhanced by pulsing the electric current so that there are high current periods followed by long periods of no current. Twenty to forty pulses per second have been found very effective in commercial stun guns with average output currents less than 3 milliamperes. Which is well below the maximum safe current.

The history of electrical shocking devices can be traced back well over a hundred years. The use of generators, both electrostatic and magnetoelectric, were used to produce electric shock on biological targets. More recently, modern electronics have allowed the miniaturization of the electrical producing systems and thereby providing a host of new inventions.

The patented invention by Thomas D. Ryan titled, "Electric Weapons", U.S. Pat. No. 2,805,067, which issued on Nov. 19, 1952, shows a number of possible electronic projectiles which could be thrown or heaved. The size of the electronics dictates a rather large device such as a spear or arrow.

Later a patent by John Cover, titled "Weapon for Immobilization and Capture", U.S. Pat. No. 3,803,463, was issued on Apr. 9, 1974. This patent described a electronic projectile device where the electronics stayed with the user and a much smaller projectile was fired at the target. This reduction in projectile size reduced the physical injury that occurred with Ryan's device, but also limited the range because wires were needed to connect the projectile to the base unit. Further Cover's device is not much smaller than Ryan's when the base unit is taken into account. Cover's later patent titled "Power Supply for Weapon for Immobilization and Capture" patent, numbered U.S. Pat. No. 4,253,132 teaches a similar tethered projectile device with an improved electronic power supply. Again range of the projectile is limited by connecting wires.

The patent by Shimizu titled, "Arrest Device", U.S. Pat. No. 3,523,538, issued on Aug. 11, 1970, shows an electronic projectile. The projectile uses two needles to puncture the target's skin so as to provide an efficient way of delivering the electric current. This device has a basic flaw in its design. Closely spaced electrodes do not easily conduct current into the nervous system of the target. Thus, extremely high currents and power levels would be needed to produce a stun effect. This device also requires the electric potential supply to be remote to the projectile, thus requiring conduction wires. This reduces the effective range of this device, and also adds to its bulk. Shimizu also discloses a electronic projectile with a direct current supply built into the projectile. This design is not even workable since the direct current battery would have to be hopelessly too large for anything smaller than a cannon ball. Even then direct current between two closely spaced electrodes can at most hope to produce a burning effect at the local area. In fact, currents must be so high to induce false epilepsy with this design, that the tissue between the electrodes would vaporize long before the target would be stunned.

The above mentioned devices are not particularly effective as can be attested by the fact that none have been very successful on the commercial market. Shimizu's and Cover's devices have the problem of wires shorting and/or breaking or not being properly grounded. The other devices are large and clumsy to use.

The stun device disclosed herein does not have the problems associated with the above prior art. A stun bullet operates with the same operational characteristics and stopping power of a standard firearm. The device would be fired like normal lead bullets and would move at high velocities. However, the bullet would be much lighter and not have the penetrating ability of normal bullets. Even less penetrating power could be optioned by reducing the muzzle velocity of the bullet, thereby reduce its kinetic energy. The range of such a weapon would be well over 100 yards and possibly accurate out to ¼ mile for systems designed for such distances. The use of widening electrodes makes this device more efficient at conducting current into the nervous system of the target than other designs, and the use of defibrillating pulses allow potentially lethal current levels to be used without endangering the target. Also modern chip-level electronics allows for a high voltage current supply to be packaged in a very tiny space, making a stun bullet possible. No other stun weapon has such range, versatility, accuracy, and ease of operation.

3. Applicant Experiments

From experiments conducted by the applicant several important facts about electric shock were discovered. These facts include: A) a shock's strength is directly related to the power dissipated within internal tissue; B) high-frequency current within pulses can actually reduce the "shock" effect; C) "shock" feel is directly related to the internal voltage and the amount of charge moved; D) high voltage is not critical to producing powerful shocks; E) pulse lengths greater than one millisecond begin to lose their efficiency at producing a "shock" effect.

Many experiments were conducted with different voltages, and wave forms. Tests were conducted with electrodes placed on the inside forearm at approximately 3 centimeters separation. This area of the arm was found to have the least skin resistance. It was further found that after a few shock tests the skin under the electrodes became much more conductive than unaltered skin. A body resistance of 250 Ohms was achieved using this method, which is probably near internal body resistance, and thus, crudely simulates an internal electrode discharge. Through these tests it was found that the "feel" of a shock depended upon the voltage, and the amount of charge moved. Equation 3 gives the "Ragner Shock Rating" ($R_{sr}$) for a capacitor discharge. Equation 3 also shows the relationship found, and predicts the apparent strength of the shock for an internal capacitor discharge. For a constant voltage discharge $R_{sr}$ would be twice as much, where Equation 4 is the general case.

$$R_{sr} = \frac{V \cdot Q}{2{,}000} \qquad \text{Eq. 3}$$

$$R_{sr} = \int \frac{V\,dQ}{1{,}000} \qquad \text{Eq. 4}$$

| RATING | EFFECT |
|---|---|
| $R_{sr} = 0.01$ | Mild tingle. Produces a non-irritating tingle. |
| $R_{sr} = 0.1$ | Sharp tingle. Produces a tingling sensation between electrodes with slight muscle contractions when applied to closely spaced electrodes. Produces a startling shock when passed from hand to hand, but easily tolerable. |
| $R_{sr} = 1$ | Sharp snap. A single pulse from a standard Stun Gun. With electrodes placed a few centimeters apart this shock produces a sharp snapping sensation much like being snapped hard with a heavy rubber band. If passed from hand-to-hand, and pulsed 30 times a second it would "stun" a person after a few seconds. |
| $R_{sr} = 10$ | Very sharp jolt. Full muscle contractions and a jarring impact to the local area with closely spaced electrodes. Could produce a stun effect if electrodes are places several centimeters apart and pulsed 30 times a second. |
| $R_{sr} = 100$ | Jarring shock. Effects felt throughout body even with closely spaced electrodes. Single pulse causes slight numbing to local area. Would be very effective as a stun device even with closely spaced electrodes if multiple pulses were used. |

Tests show that Equations 3 and 4 to be accurate over a very wide range of shocks. However, pulses longer than 1 millisecond start to appear more like direct current to the body and begin to produce a burning sensation at the electrode sight instead of producing a "shock". Multiple pulses increase the apparent strength of the shock, but not in a linear fashion. Pulse rate and exposure time all effect the perceived shock. A commercial stun gun was used as a median reference shock, and arbitrarily given a "Ragner Shock Rating" ($R_{sr}$) of 1. A 10 on the "Ragner Scale" would feel 10 times stronger than a rating of 1, and a 100 would be 100 times stronger than a rating of 1. Likewise a rating of 0.1 would feel 10 times weaker than a rating of 1.

The proportionality constant of 2,000 was chosen because it was near the center of experimental deviation. Tests showed Equation 3 to be accurate in predicting shock "feel" for a single capacitor discharge pulse over a very wide range of values. Voltages from 145 to 1000 volts, and charge movements of 0.3 to 500 microcoulombs all showed linear changes in perceived shock "feel". Tests were conducted from $R_{sr}$ equal to 0.01 to as high as 85 on the "Ragner Scale".

The "Ragner Scale" is also an energy scale. Since charge moved times voltage equals the work done, Equations 3 and 4 represents a normalized energy scale. By accident, the proportionality constant "1/2,000" results in a "Ragner Shock Rating" of 1 ($R_{sr}$=1) being equal to exactly 0.001 joules. Likewise, a $R_{sr}$=100 pulse on the Ragnet Scale would contain 0.1 joules of energy.

Shocks with ratings greater than 30 and which are pulsed 20 times or more per second would be very effective for a stun bullet. Shocks below 1 would mostly be used as a deterrent weapon. If 0.1 joule (100 on the Ragner Scale) pulses are applied 30 times a second, the current flow can reach the maximum safe level determined by Equation 1 within one or two seconds. A longer duration shock could prove lethal if the heart is placed directly in the path of the current flow and the target is old and frail. The pulse nature of the discharge would more than likely eliminate the possibility of heart fibrillation, but just in case, a defibrillating pulse can be applied several seconds after being stunned. The defibrillating pulse would just be a single pulse from the same circuitry which created the multiple pulse stun effect. If needed the pulse can be modified to provide the proper pulse signature for effective defibrillation.

To produce shock pulses with ratings above 40 (0.04 joules), voltages of 170 volts or more are needed. At lower voltages (at least through ionized skin) current levels are too low to discharge a capacitor in less than 1 millisecond. Thus, the efficiency of the shock's "feel" is reduced. Voltages greater than 200 volts should be used for shock ratings of 100 (0.1 joules) or more. These voltages are small compared to the voltages used by most stun guns (eg. 50,000 volts). These lower voltages are possible because electrodes will puncture the skin. Thus, the electrodes will "see" an internal resistance around 250 ohms or less (higher currents produce lower internal body resistances). By using these lower voltages, the efficiency at which power is conducted to the target is greatly increased. In experiments, some of the 170 volt needed for efficient shocks of ratings greater than 40 is needed to penetrate the skin. Thus, electrodes which have punctured the skin could require less than 100 volts to stun a person. To produce a deterrent effect much lower voltages can be used. Thirty milliamperes is a considerable shock when a continuous alternating current is used. With a internal body resistance of 500 ohms, 30 mA can be produced by only 15 volts. Voltages this low are easily produced by battery alone. Thus, "deterrent bullets" could be made with just a battery, and electrodes. The "deterrent bullet" could be further enhanced by adding a simple oscillator to the battery to produce a square wave output, or a switching circuit to change the polarity of the electrodes many times per second. At slightly higher voltages, and currents, this type of oscillating circuit could be used as a stun bullet.

OBJECTIVES AND ADVANTAGES

Accordingly, several objects and advantages of my invention are:

a) Extremely small size allows large numbers of bullets to be carried by user.

b) High speed delivery does not allow the target time to avoid the attack.

c) Effective range up to ¼ mile, when weighted, make it useful even as a sniper weapon.

d) Stops target even if the target is hit in the arm or leg.

e) The stun bullets are compatible with standard firearms and firearm cartridges. The bullets can be loaded into standard firearms (handguns, rifles, shotguns, etc.) without modifications.

f) Use in standard firearms allow rapid fire so that more than one bullet can be used to assure the target is stunned.

g) Use in standard firearms allows easy switching from non-lethal stun bullets to standard lethal bullets.

h) Use of defibrillating pulses after initial shock allows for very heavy stun currents to be used without endangering the target.

i) The use of expanding electrodes allows more efficient conducting of electrical current into the nervous system of a biological target.

DRAWING FIGURES

FIG. 1 Section view of a stun bullet.

FIG. 2 Isometric view of a stun bullet just after exiting the barrel of a firearm (gun barrel).

FIGS. 3A to 3E Illustrates that the unfurling of the darts after exiting the barrel of a firearm (gun barrel).

FIG. 4 Graph of current output of stun bullet.

FIG. 5 Schematic of the preferred embodiment electronic circuit.

FIG. 6 Isometric view of an alternate stun bullet design.

FIG. 7A Section view of a simple deterrent bullet.

FIG. 7B Section view of a simple deterrent bullet after impact.

FIG. 8A Section view of a simple deterrent bullet.

FIG. 8B Section view of a simple deterrent bullet after impact.

FIG. 9 Schematic of an alternative electronic circuit for any of the above stun or deterrent bullet designs.

FIG. 10 Isometric view of an alternate embodiment of the duel point dart electrode.

FIG. 11 Side view of an alternate embodiment with stiff electrode wires.

DETAILED DESCRIPTION OF THE PREFERRED EMBODIMENTS

Figure 1:
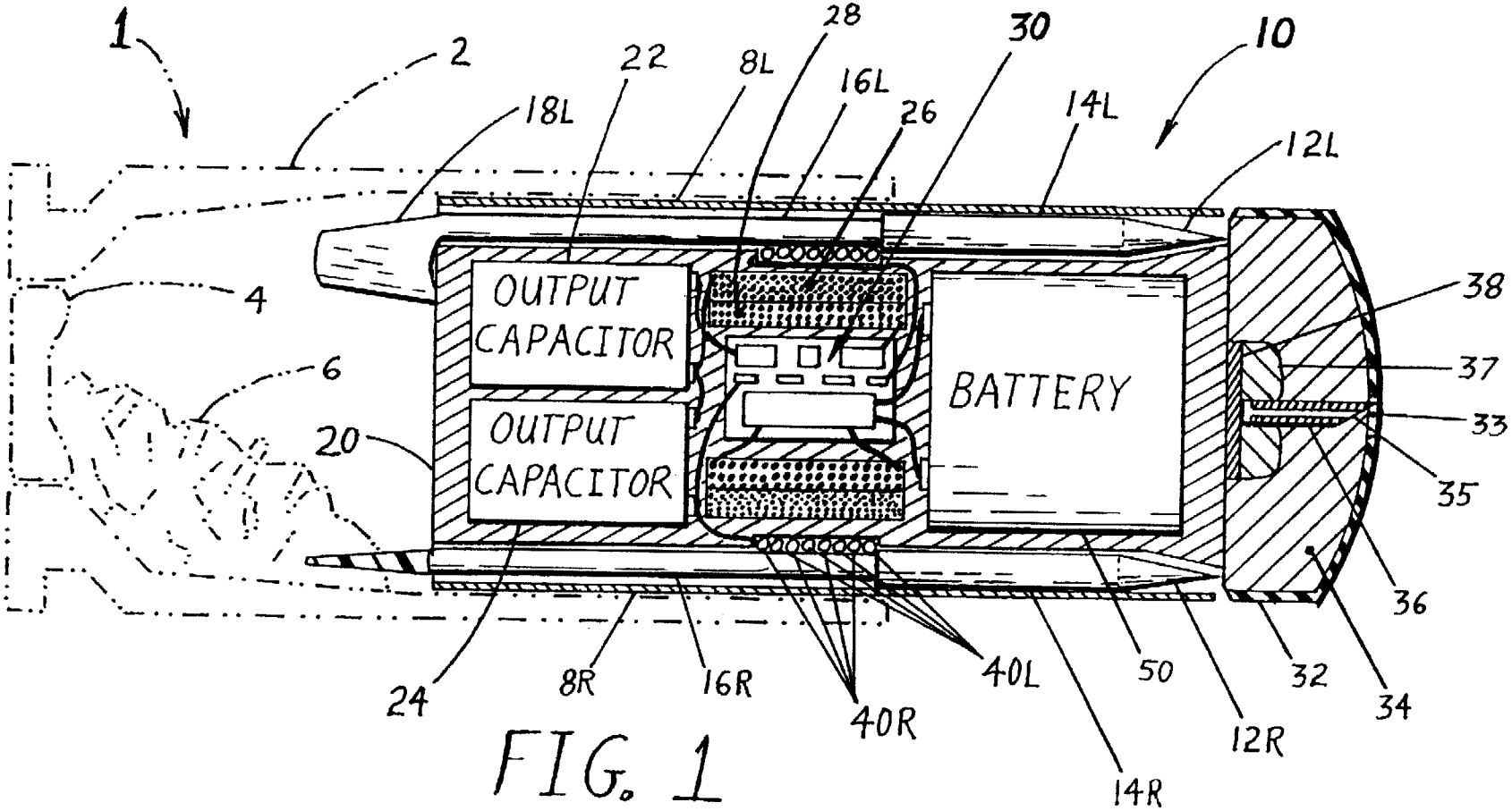

FIGS. 1 through 5 refer to a single design, the preferred embodiment. The design consists of a standard cartridge 1, plastic sheaths 8R and 8L, and stun bullet 10. Cartridge 1 consists of casing 2, primer 4, and gunpowder 6. Stun bullet 10 is crimped into casing 2 with sheaths 8R and 8L surrounding it. The sheath is not absolutely necessary, but helps keep the stun bullet from being scored when fired. Friction holds the sheath around the stun bullet when fired. Dimples, ridges, or other matching surfaces (not shown) could also be used to prevent slipping.

Stun bullet 10 can be broken down into four major components: A) the housing which holds all the components, B) a pair of electrode darts and its corresponding wires, C) a nose cap with energy absorber and tranquilizing syringe at the front of the stun bullet, and D) the electronics to provide a incapacitating electric current. These four components will be discussed separately.

Electrode

Figure 2:
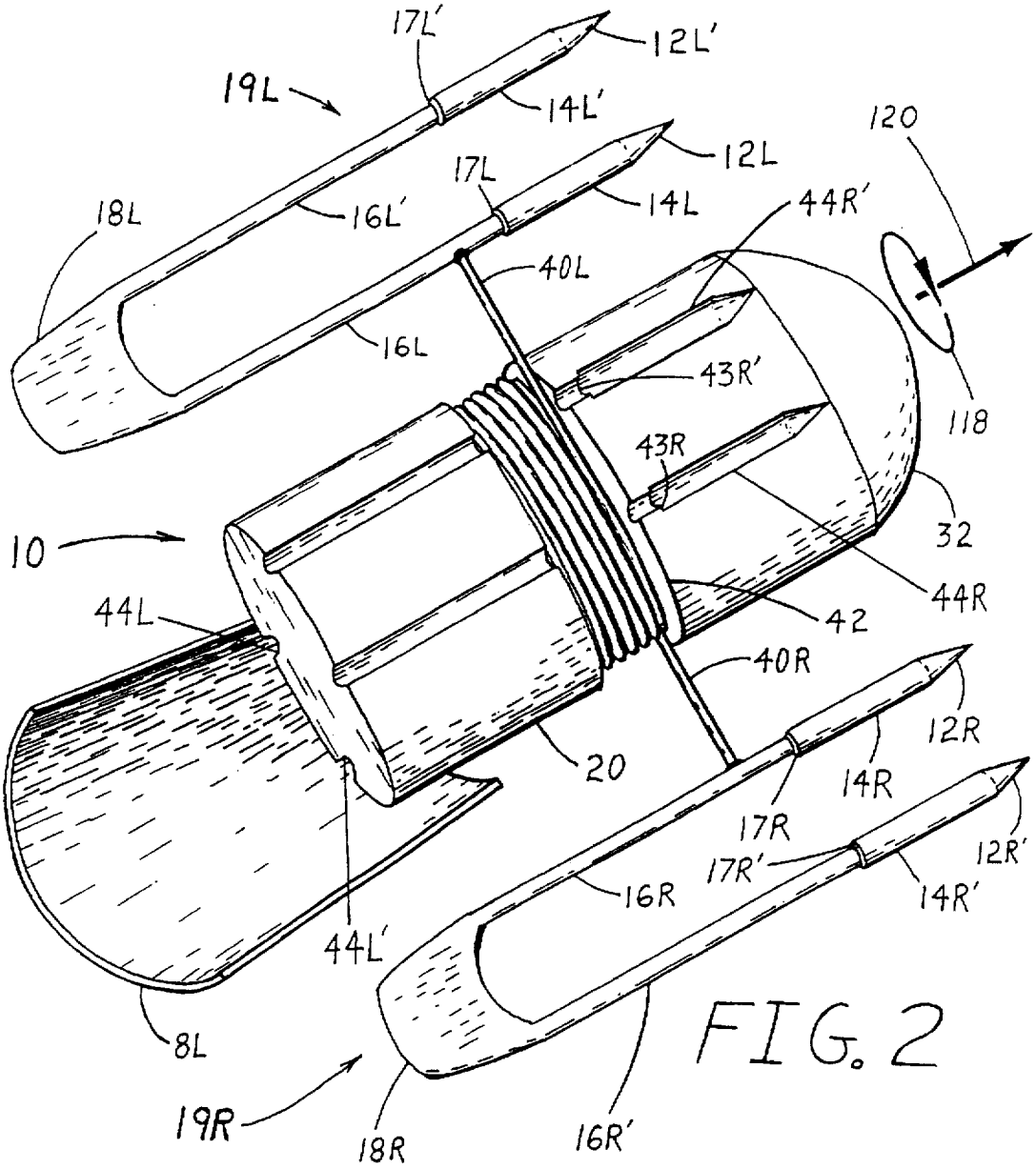
Figure 3E:
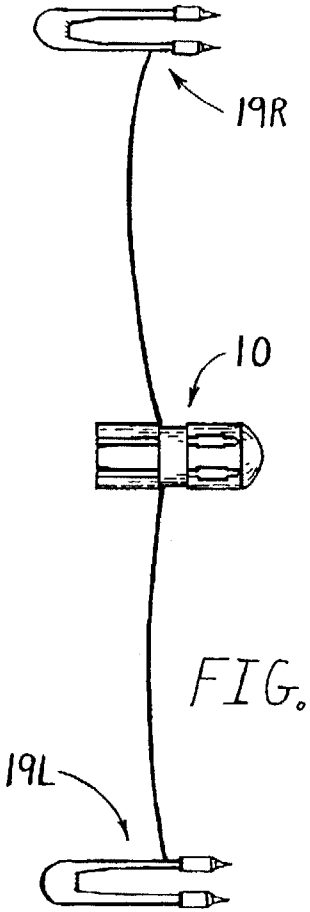
Figure 3D:
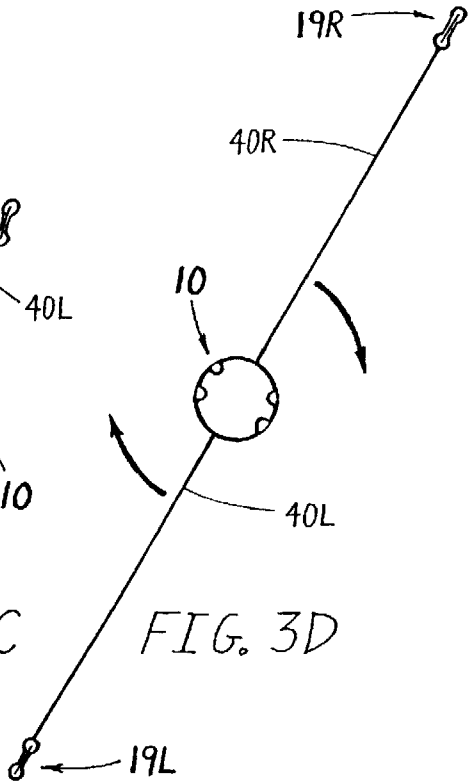
Figure 3C:
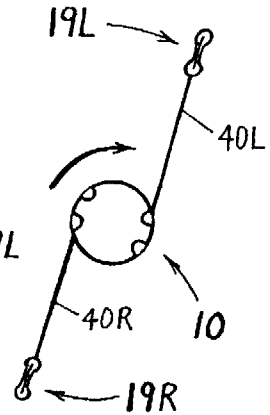
Figure 3B:
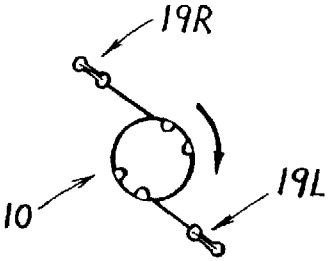
Figure 3A:
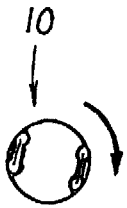

The electrode design shown in FIG. 2 is a duel dart design. Many other designs are possible which provide proper operating characteristics. These operating characteristics include: A) aerodynamically stable so that the sharp tips point forward, this means the net force vector on the electrode must be behind the center of mass, B) there should be a structure on the rear portion of the electrode that stops the electrode from penetrating too far into the target, C) a method of keeping the electrodes pointing in its direction of motion even if the electrode(s) miss the target and swings around the target due wire tension, D) the aerodynamic drag-to-weight ratio of the electrode and wire should be similar to the drag-to-weight ratio for housing 20, thus air drag decelerates both at approximately the same rate, and keeps electrodes 19R and 19L out to the sides of the housing due to centrifugal forces.

Stun bullet 10 has two such electrodes, electrode 19R and 19L. Electrodes 19R and 19L are identical in both structure an operation. Looking at the right electrode 19R we see it has rear portion tail fin 18R which is flat and has a relatively large surface area compared to the rest of the electrode. Connected onto this fin is two electrode shafts 16R and 16R'. On the end of these shafts are placed sharp tips 12R and 12R'. Also on the forward portion of the electrode are more massive sections 14R and 14R' with ridge 17R and 17R' on the rearward end. Ridges 17R and 17R' provide both a means to hold the electrode in place when fired, and a means of holding the electrode within a biological target after impact. Since ridges 17R and 17R' are not angled rearward like barbs the electrodes can be pulled out without tearing the tissue of the target. Shafts 16R and 16R' are aligned so that they slightly diverge at the tips. This causes them to spread slightly on impact, and thus hold onto the targets tissue after impact.

Wires 40R and 40L connect electrodes 19R and 19L respectfully to housing 20. These wires hold the electrode to the housing physically as well as electrically. The wire can be insulated or uninsulated. Insulating wires 40R and 40L have the advantage of being able to operate even when tangled. The wires themselves are relatively stiff and tend to align the electrodes in the forward direction by just the stress built into them. In fact, by using a very stiff, very springy wire such as piano wire the need for aerodynamic stabilizing fins might be totally eliminated. The stiffer wires also have less chance of tangling. When stored (see FIG. 2), wires 40R and 40L are wound around housing 20 in spool 42 and are recessed enough to not bind with electrodes 19R and 19L when the electrodes are placed in grooves 44R, 44R', 44L, and 44L'. Depending on the placement of electronic components wires 40R and 40L could be wound in the radial fashion, that is, the wires would be wound one atop another in a single plane. This would be preferred to the cylindrical winding method shown in the drawings. It is preferred because all the windings can be placed at the longitudinal center of gravity. By placing all the windings at the center of gravity any rotational torques produced by the electrode wires will be along the length of housing 20. Thus, the unfurling of the electrodes would not cause direction changes of the housing and the bullet housing will fly true. This is all unnecessary if such stiff-springy wires are used that the bullet electrodes are basically spring loaded and overpowers any rotational torques that might cause problems. The wires connect to the electrodes near the center of mass of the electrodes. This provides balance while rotating and also keeps the electrodes perpendicular to the connecting wires when swinging around in an arc, such as when the one electrode misses the target.

Housing

Housing 20 is a single molded piece of high impact plastic. All the electronic components are molded within this plastic housing. Completely surrounding the electronic components with plastic helps protects them from the high impact forces experienced. Housing 20 also provides a place to mount plate 38, and foam rubber tip 34. On the sides of housing 20 are grooves 44R, 44R', 44L, and 44L' which are shaped to hold electrodes 19R and 19L. Ridges 43R, 43R', 43L, and 43L' mate respectfully with holding ridges 17R, 17R', 17L, and 17L' on the electrodes to hold the electrodes in place when the stun bullet is fired. These ridges could be eliminated if the length of the electrode were reduced to fit within the length of the housing.

Nose Cap

The front portion of stun bullet 10 comprises an energy absorbing foam rubber 34 with urethane cover 32 covering the foam rubber to provide a relatively hard outer surface so that the bullet can be used in auto loading firearms (fully and semi automatic). The foam rubber and urethane cover is mounted onto the front of housing 20. Within the foam rubber is a syringe and needle for injecting a tranquilizing solution. Needle 36 is mounted on back plate 38 which is in turn molded into housing 20. Syringe 37 sits at the base of needle 36 with passageway 35 connecting the tip of the needle to the syringe chamber.

Electronics

The number of electronic circuits that could be used in an effective stun bullet would take volumes to discuss. Therefore this patent application makes no attempt at patenting any specific electronic circuit. Both pulsed, and direct current outputs could be used. Direct current is much less effective at stunning a target, but Could make a very good deterrent current source.

Figure 5:
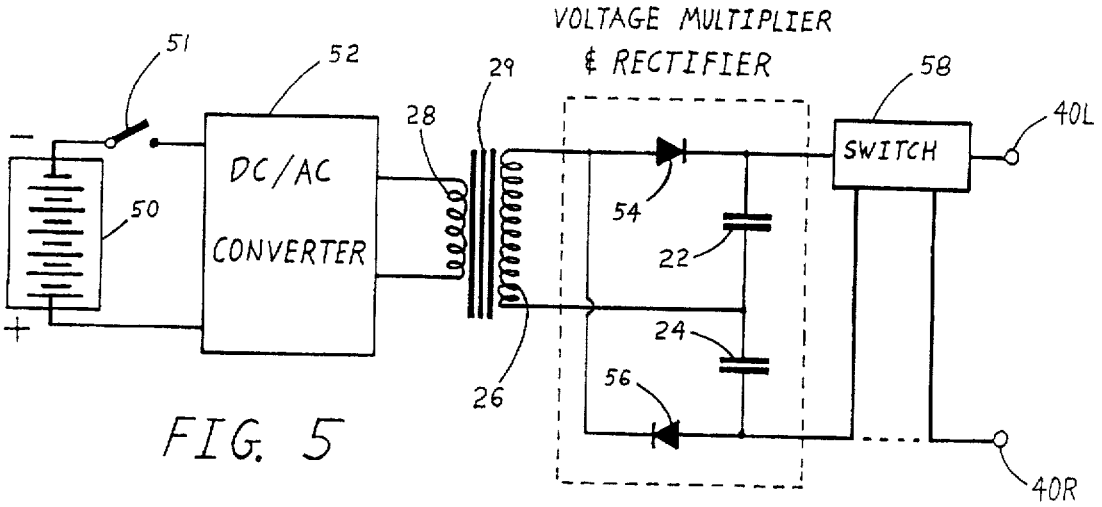

FIG. 5 shows one possible circuit for a stun bullet. A low voltage battery (1.5 to 15 volts) is connected to DC/AC converter 52 when switch 51 is closed. Switch 51 is an acceleration actuated switch which closes upon firing of the bullet. The acceleration at which switch 51 would close should be set high enough that simply dropping the bullet would not turn it on. Battery 50 is a high power output battery with very thin plates to maximize its power to weight ratio.

DC/AC converter 52 could be a simple oscillator or a switching regulator in chip form. The components need to be in chip form because of the size limitations. If only low voltages are required the output from a switching regulator could directly charge output capacitors 22 and 24. If higher voltages are desired a transformer can be used. In FIG. 5 the AC output from DC/AC converter is feed into primary coil 28. Through mutual inductance secondary coil 26 steps up the voltage which is output to a subcircuit labeled "Voltage Multiplier & Rectifier" surrounded by a dashed box. Because the transformer must be very small to fit within the confines of a standard bullet, the coils must be very small. Thus, relatively efficient output powers can be obtained by using a high frequency primary. Because of these high frequencies core 29 should be a low hysteresis ferrite. For most efficient operation coils 26 and 28 would be surrounded by this ferrite core (note: ferrite core not shown on FIG. 1 for clarity). The ferrite core could also surround the other electronic components which would fit within coils 26 and 28. The coils or windings would actually be wound around the chips.

Capacitors 22 and 24 have similar values and are used to store the electrical energy coming from the rectifier. Two capacitors are used here because they are part of the voltage multiplying circuit. In general, only a single capacitor is needed if such a voltage multiplier circuit was not used. The capacitance value of these capacitors depend greatly on the intended use (deterrent, stun, or heavy stun) and the operating voltage. It is more informative to talk about the energy stored within the output capacitors since the energy released through switch 58 is directly related to how strong a shock is felt by the target. For stunning a person the output capacitor or capacitors should deliver from 0.001 to 0.5 joules per pulse, assuming a 30 pulse per second rate. At the low end 0.001 joule pulses would represent the shocking potential of a cheap stun gun which can be bought at any army surplus store. At the high end, 0.5 joule pulses represent very nearly the maximum power a tiny eraser-head sized battery can be expected to produce even for a few seconds. One-half joule pulses firing at thirty pulses per second is also well above the non-lethal range of electric shock if the heart is placed in the circuit. At these high power levels a defibrillating pulse 114 (see FIG. 4) would be used to stop the target's heart from fibrillating (should it occur). To produce defibrillating pulse 114, capacitors 22 an 24 would be discharged into the target one time. Switch 58 would close and deliver the shock. For safety switch 51 could be timed to re-open after defibrillating pulses 114, and 116. This would prevent accidentally getting the bullet stuck producing output pulses.

Switch 58 could consist of any number of different circuits. In its simplest form it would be a spark gap or a breakdown diode which would simply release the stored charge when a certain voltage across capacitors 22 and 24 was achieved. In this simple case switch 51 would need to be timed so that it would open to shut the electronics off after the desired shock duration. In the more complicated case (see FIG. 5) switch 58 would consist of electronically controlled switches. A simple timing circuits opens and closes electronic switches to produce the output wave form seen in FIG. 4. Switch 58 also changes the polarity of the current going to wires 40R and 40L every several pulses or so. The switching of polarity has the advantage of evening out the acids and bases produced at the puncture sights by electrolysis. The tissue directly around the electrode's surface would thus alternate between acidic and basic. This environment should prove hostile to any bacteria or virus, and effectively disinfect the puncture sight.

Alternative Embodiments—FIGS. 6 to 8B

Figure 6:
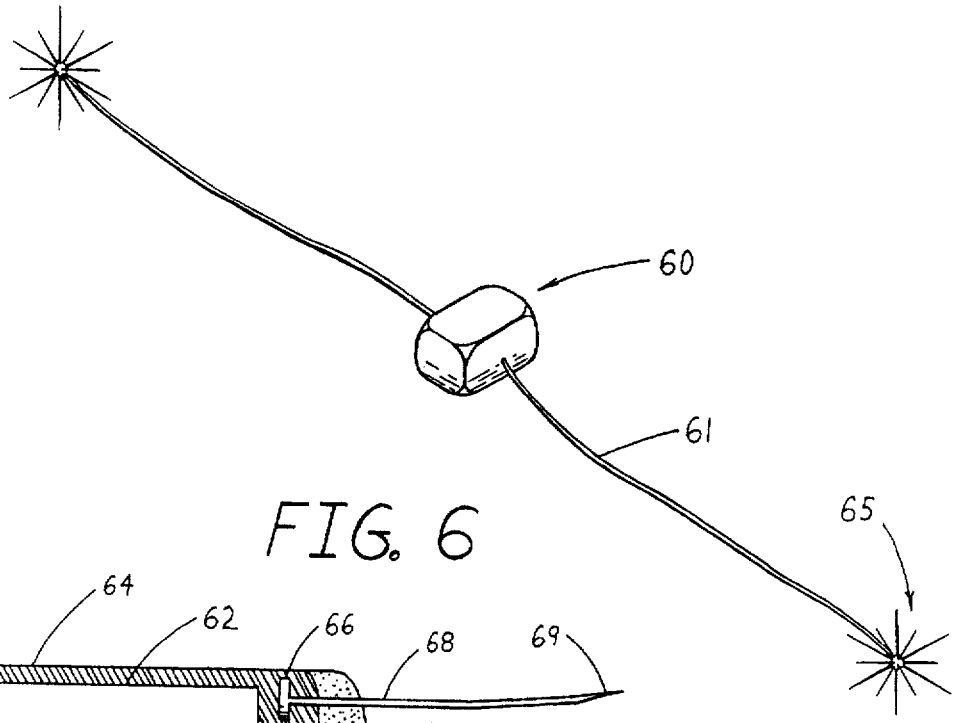

FIG. 6 shows an alternate stun bullet in flight. Housing 60 contains the battery, and electronics, and is attached to two multi-prong electrodes 65 by conductive wires 61. The right and left electrode, and wire are identical, with the right-side electrode and wire being labeled. Electrode 65 has sharp needles all around it, which are designed to puncture the clothing, and skin of a target. Because the electrodes have no preferred direction, no aerodynamic stabilizing is needed to keep the points facing forward. This design also does not require rotation of the housing for proper operation. Wires 61 provide sufficient stiffness to keep the electrodes extended.

Figure 7A:
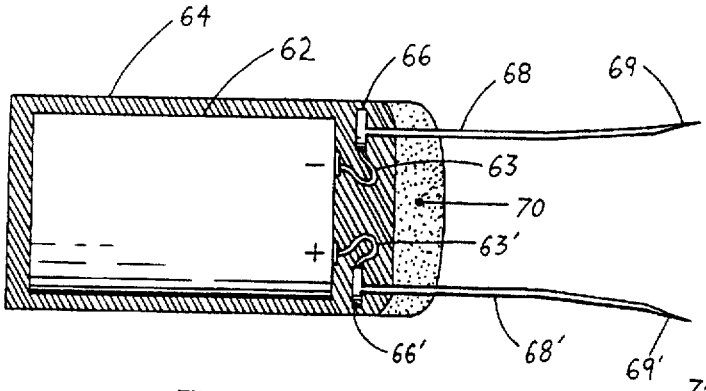
Figure 7B:
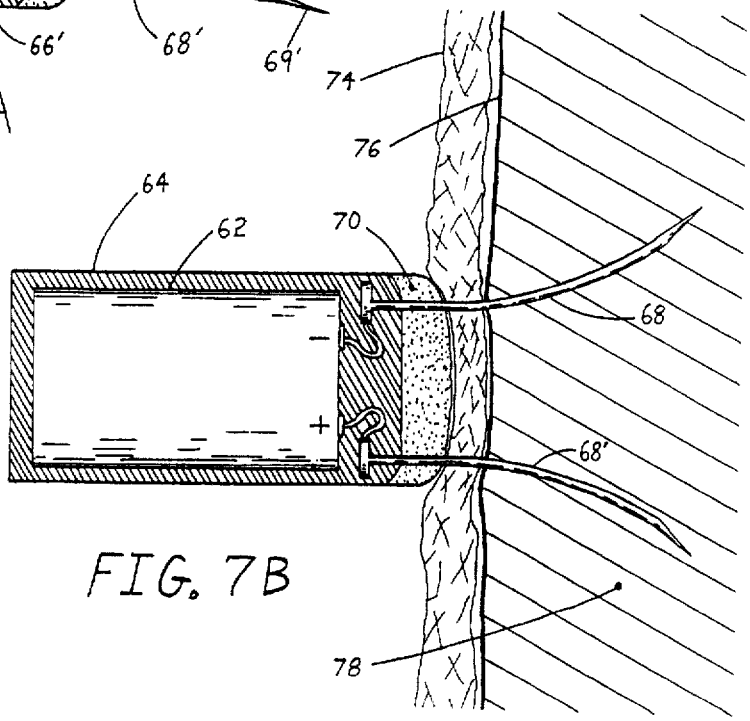

FIGS. 7A and 7B show a third embodiment that shows a greatly simplified design. The first embodiment was meant to show how many features and functions could be placed on a stun bullet. This design shows how few function are actually needed. Battery 62 is molded into plastic housing 64 as is the base of the electrodes 66 and 66'. Electrode tips 69 and 69' point forward and are sharp enough to puncture the skin. Electrode shafts 68 and 68' are slightly bent outward with the tips angled away from the center line of the housing. The electrodes are electrically connected to the battery terminals by wires 66 and 66'. At the front of the housing is a pad of energy absorbing foam rubber 70. The general shape of this stun bullet is similar to that stun bullet 10, having the shape of a cylinder.

Figure 8A:
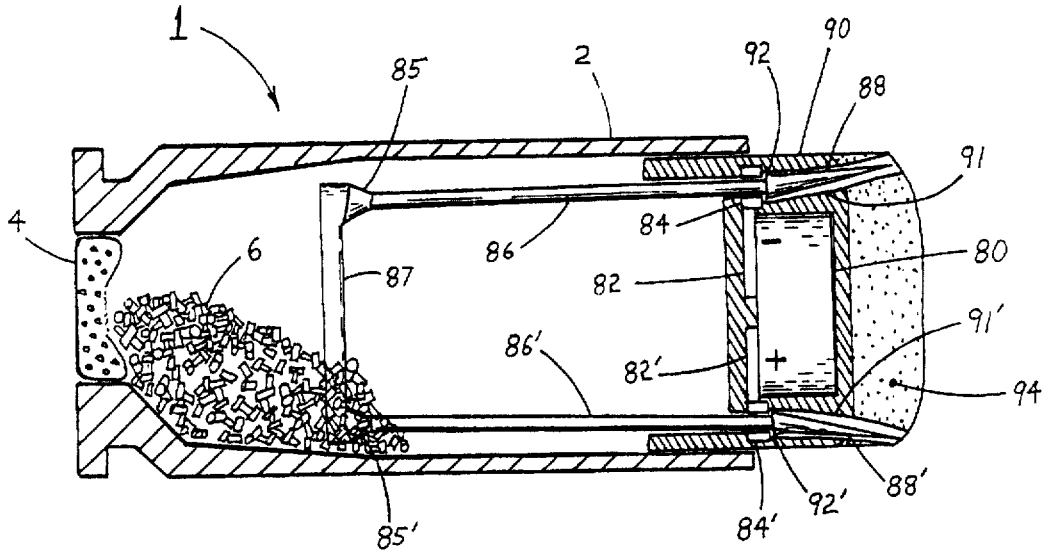
Figure 8B:
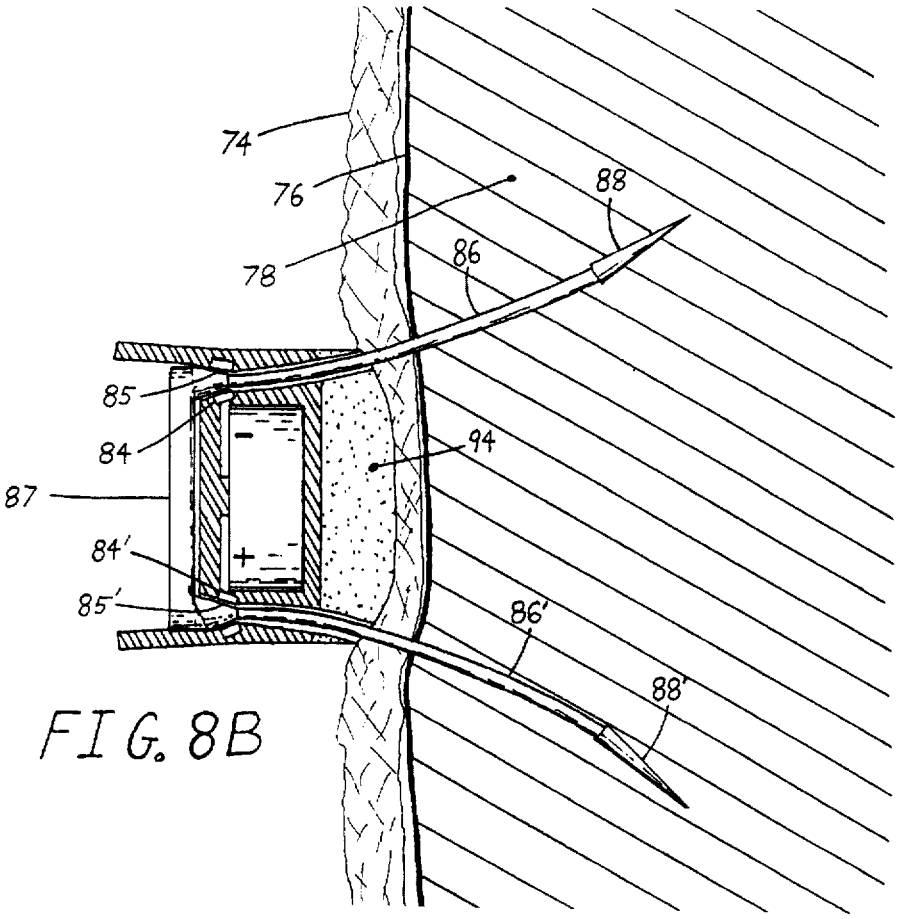

FIGS. 8A and 8B show a third embodiment where electrode tips 88 and 88' are concealed with housing 90. Electrode shafts 86 and 86' extend behind housing 90 and are linked together by a non-electrically conductive support 87. Rings 84 and 84' surround electrode shafts 86 and 86', and allow the electrodes to slide within the rings. These rings are electrically conductive and are connected to battery 80 at poles 82 and 82'. Cone shaped connectors 85 and 85' at the rear of each electrode shaft are slightly larger in diameter than the inside diameter of rings 84 and 84', and designed to wedge themselves into the rings when forced forward. Ridges 92 and 92' communicate with the edge of rings 84 and 84' to prevent the electrodes and support from sliding backward out of the housing. Channels 91 and 91' are angled outward and sufficiently reinforced to bend electrode tips 88 and 88' outward away from the center line of the bullet. Foam rubber pad 94 is placed at the front to absorb impact.

In this design a very small battery is used to reduce the impact energy of the bullet and to provide a small current for deterring the target and not stunning it. Also, because direct current is not effectively conducted to the nervous system of biological targets these last two designs would mostly be used as a deterrent device. They would produce two holes similar to a hypodermic needle and a little bit of bruising around the impact area. However the release of electrical current would produce a great deterrent. Alternatively, if a circuit designed to pulse the current was added to the battery, then more energy would be conducted to the nerves. With the pulses tuned to the resonance of the human nervous system (around 20 to 60 pulses per second) these stun bullets with needle tip spacing (after impact) of one to two inches, could stun a person.

Figure 9:
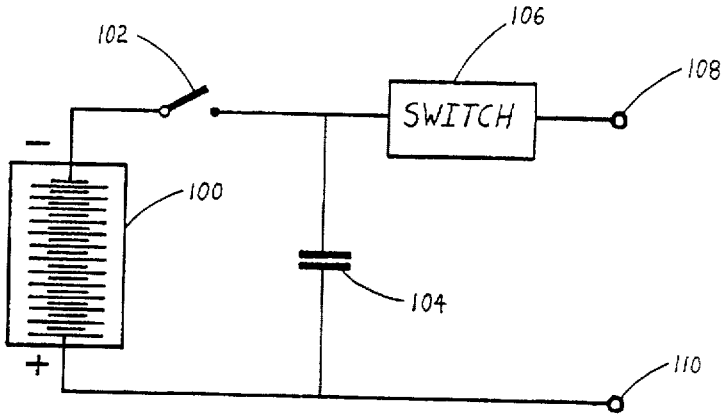

Alternate Circuit—FIG. 9

FIG. 9 shows an alternative stun circuit that could be used in any of the stun bullet designs shown. In particular, if this design were used in the embodiment shown in FIG. 1, stun bullet 10 could be reduced in weight by eliminating the transformer coils 26 and 28, and core 29. This extra space could be used to put in a larger more powerful battery and/or larger output capacitor.

In FIG. 9, high voltage battery 100 is connected in parallel with output capacitor 104 when switch 102 is closed. Switch 102 is an acceleration switch that closes when the switch experiences high acceleration. Switch 102 could also be timed as a safety factor and turn the system off after a predetermined time period. Switch 106 is an electronic switch which can close and open depending on the voltage across capacitor 104 or on a timing circuit. The simplest would be a spark gap or other voltage breakdown devices. In this case the voltage buildup across capacitor 104 would be released when it reached a specific voltage, which must be below the voltage of the battery. Battery charging rate, and the capacitance value of the capacitor would determine the firing rate of the output pulses which would appear across poles 108 and 110.

Figure 10:
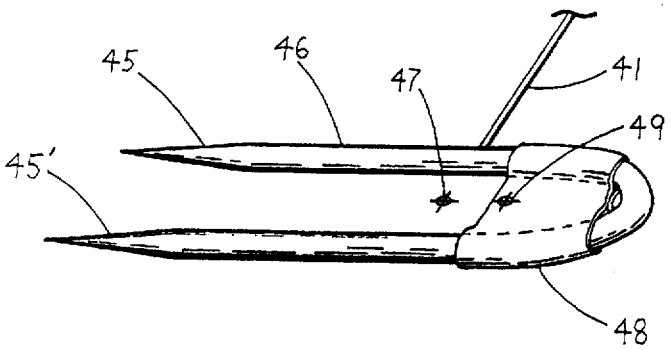

Alternate Electrode—FIG. 10

Many electrode designs are possible, including single and multiple point electrodes. The design shown in FIG. 10 is dual prong electrode 46. This electrode is made from a single piece of piano wire. The wire is bent in a "U" shape, and ends 45 and 45' are sharpened and polished to allow easy puncture of skin. Wire 41 is connected near the center of gravity 47 of the electrode. On the rear portion of the electrode stabilizer 48 is affixed. This stabilizer can be as simple as a piece of masking tape to a form fitted plastic insert. For stable aerodynamic flight the center of air drag force 49 should be located behind the center of gravity 47 of the electrode. However, if wire 41 is sufficiently stiff, electrode 46 would not even need stabilizer 48. The wire itself would hold the electrode straight.

Figure 11:
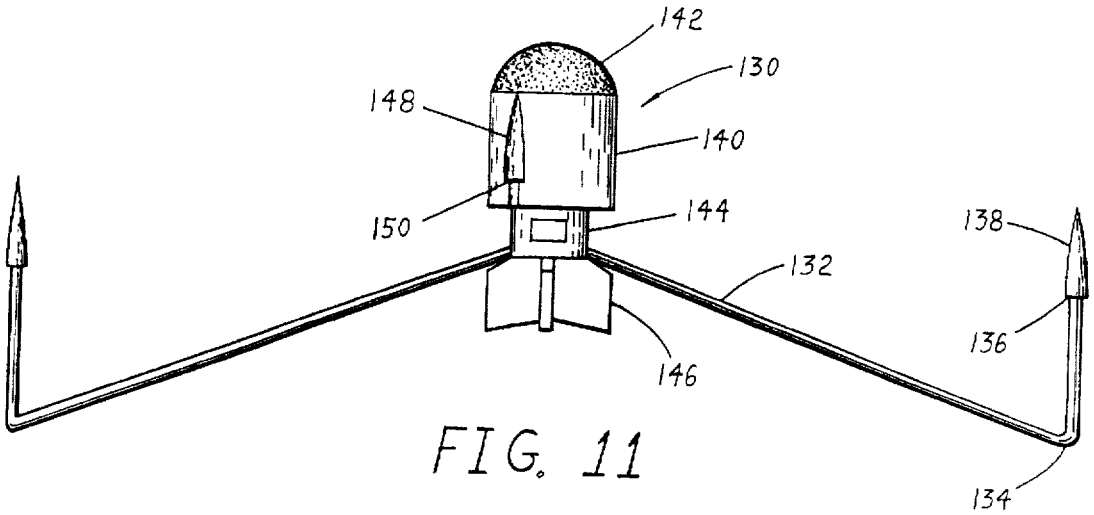

Alternate Stun Bullet—FIG. 11

There are many ways the stun bullet can be configured. In FIG. 11 we see a stiff electrode wire stun bullet. The bullet consists of a housing 130, and two identical electrodes 138 and wire connectors 132 (only right electrode numbered). Housing 130' consists of a rubber nose cone 142 which is capable of absorbing impact shock, an electronics section 140, a spindle section where wires 132 are wound before firing, and tail section 146 which helps stabilize the bullet in flight. Electronics section 140 has two identical indentions 148 (only one shown) with a ridge 150 near the back portion. These indentions are designed to hold the electrode tips 138 before firing. Ridge 150 communicates with ridge 136 to hold the electrode in place before leaving the gun barrel. Wire electrodes 132 are connected to spindle 144, and consist of an electrode wire 132, and electrode tip 138. Wires 132 have a large enough diameter that the electrode tip 138 points forward at all times due to the stress in wire 132, but are springy enough to allow winding around spindle 144 without permanently deforming. Wire 132 is bent near the end at bend 134, and the end of the wire becomes part of a needle electrode. Tip 138 has a sharp point, and a ridge 136. Ridge 136 is designed to catch on ridge 150 sufficient to hold tip 138 in place when being fired from a gun or firearm.

Operational Description—FIGS. 1 through 11

In FIG. 1 we see the stun bullet loaded into a standard 9 mm cartridge 1 shown in shadow. When placed in a firearm, and primer 4 is detonated, gun powder 6 is ignited, and the stun bullet is propelled out of the gun's barrel. Because standard firearms have rifling on the inside of their barrels, stun bullet 10 is rotating at high speed when it leaves the barrel.

In FIG. 2 we see the stun bullet in mid-flight just after leaving the gun's barrel. The plastic bullet sheaths 8L and 8R (see FIG. 1) have separated from the bulk of the stun bullet as air pressure pushes them away. As the bullet sheaths move out of the way electrodes 19L and 19R come out of groves 44R and 44R', and 44L and 44L' due to centrifugal forces. Wires 40L and 40R are wound in the opposite direction to the rotation of the bullet so that as the wire unwinds the angular momentum of the bullet is transferred to the electrodes in a smooth manner.

In FIGS. 3A through 3E we see the progression of the stun bullet as the electrodes spin outward. After fully extended the entire system is rotating much slower due to the greater angular inertia. The longer wires 40L and 40R are made, the slower the final rotation. Centrifugal force tends to keep the wires tight and the electrodes stable. The stiffness of the wires help stabilize the electrode. The only unstable axis for electrodes 19L and 19R is along the wire, because the torsion strength of the wire is very small. To stabilize the electrodes along this axis tail fins 18L and 18R produce a air drag toward the rear of the electrode to keep tips 12L, 12L',12R, and 12R' pointing in the direction of motion.

On impact electrodes puncture clothing and skin as they strike the target at high speed. Normal spreading of the tips will tend to wedge the electrode in the target because two separate shafts are used. Ridges 17L, 17L',17R, and 17R'also tend to hold the electrodes in the target. Because barbs are not used, and the diameter of the electrodes are comparable to a hypodermic needle, thus the electrodes can be pulled out without causing major tissue damage. The electrical system (see FIG. 5) has already been activated by the high acceleration of firing the stun bullet and switch 51 has closed because of this acceleration. Battery 50 then powers the DC to AC converter producing an alternating current through coil 28. Core 29 provides high mutual inductance with coil 26 forming a transformer. The high output voltage from coil 26 is rectified by diodes 54 and 56. Capacitors 22 and 24 store charge as the current from coil 26 oscillates. At a determined voltage or time, switch 58 closes, and completes the circuit. Current then flows from capacitors 22 and 24 through wire 40L, electrode 19L and into the target. The current then flows through the target, disrupting nerve impulses, and back through electrode 19R, and wire 40R to the capacitors. The switch then opens and capacitors 22 and 24 begin to charge again, and the process repeats. After several shocks switch 58 changes the polarity of the current going to the electrodes. This is done to prevent infection of the puncture wounds. By switching polarity every few pulses, hydrogen peroxide is produced at each electrode to disinfect the wound area. After several seconds of pulses the pulses stop. Then a few seconds later a single pulse is given. This is in case the target's heart has gone into fibrillation (not a problem if power is kept below potentially lethal levels). By providing this defibrillating pulse much higher power levels can be used. In fact, the pulse nature of the electric output would itself tend to defibrillate the target. A few seconds after the first defibrillating pulse one or more additional pulses are applied. These electrical pulses leaves the target immobilized, and possibly unconscious.

Figure 4:
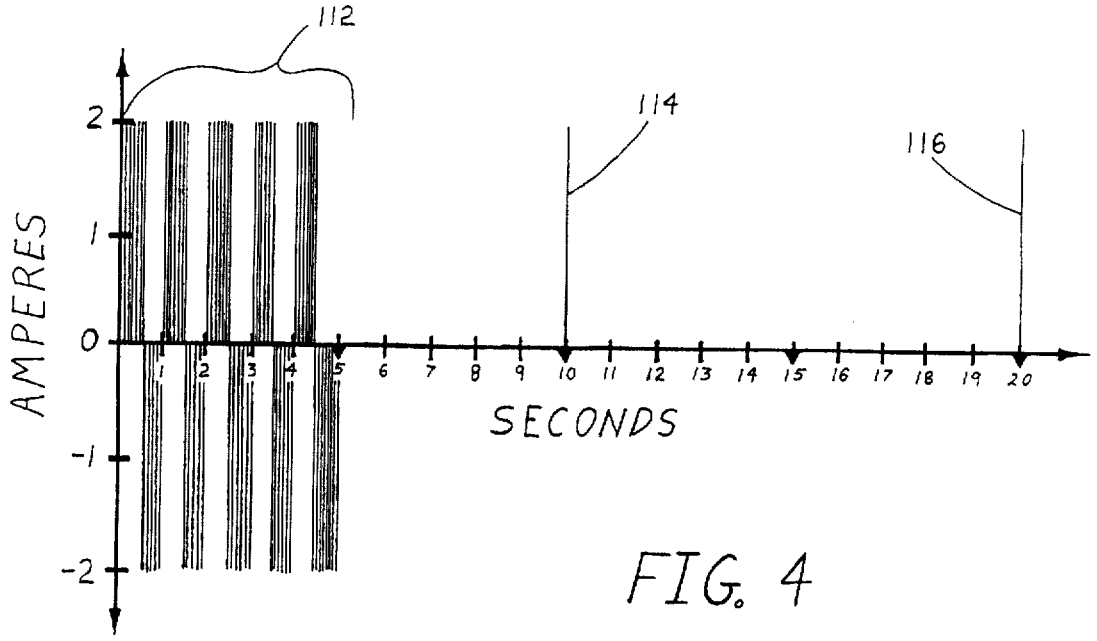

FIG. 4 shows one possible current output for the stun bullet. Stun pulses 112 are each only a few tens of microseconds in duration with as many as 500 pulses per second (approx. 12 pulses per second shown in FIG. 4). The pulses are shown switching polarity every half second. Defibrillating pulses 114 and 116 are applied several seconds after the initial stun pulses to stop heart defibrillation if it has occurred.

Also on impact, as bullet housing 10 strikes the target, the target is injected with a tranquilizing solution. Urethane cover 32 actually makes contact with the target, and high-density foam rubber 34 beneath is used to absorb some of the impact energy. Hypodermic needle 36 punctures cover 32, and is force into the target as the foam rubber is compressed. The needle is mounted on base plate 38 to which a tranquilizing solution is associated. As the foam rubber compresses, the tranquilizing solution in chamber 37 is forced down passageway 35 within needle 36, and into the target. Because the volume of the tranquilizer is small in this design, the tranquilizer must have a high reactivity. Larger tranquilizer reservoirs can be incorporated if desired, with spring loaded syringes to would inject the solution after impact.

Operation of Alternate Designs

FIG. 6 shows an alternate stun bullet in flight. The bullet can be propelled in several different ways including shotgun, rifle, air gun, $CO_2$, grenade, or other explosive device. This design will operate with or without barrel rifling, and the multi-prong electrodes 65 allow for great misalignment in the launching system. Wires 61 hold electrodes 65 away from housing 60. If the bullet is tumbling it is still functional since the electrodes are rarely in line with each others flight path. Thus, on impact The multi-prong electrodes 65 provide a multi-directional method of puncturing a target's clothing and skin. The electrodes hold onto the target by the spreading of the needle points under the skin of the target. After the electrodes have made electrical contact with the target the electronics within housing 60 produce short output pulses of direct current through the target.

FIG. 7A shows an alternate stun bullet (or deterrent bullet) in its most basic design, having a housing 64, a battery 62, and two electrodes 68 and 68'. On impact, shown in FIG. 7B, this bullet pushes electrode tips 69 and 69', through clothing 74, skin 76, and into body tissue 78. The curved nature of shafts 68 and 68', and tips 69 and 69' cause the electrodes to spread on impact and thus expanding the tips outward. This expansion effectively wedges the electrodes into the target's body tissue 78 keeping them from sliding out. The expansion also increases the distance between the electrodes, thus increasing the volume of tissue receiving high currents. The electrodes are also slightly angled (not shown) into the direction of rotation. The angle of the electrodes should closely match the rotation of the bullet so that the needle enters cleanly. Thus, after the electrodes have entered the target, and foam pad 70 impacts the target's clothing, the electrodes catch on clothing, skin and tissue to stop its rotation. These electrodes are electrically connected to the battery terminals with wires 63 and 63'. Current flows between the two electrodes within the target causing a deterring effect. If a stun effect is desired a switching circuit (not shown) can be placed in series with the current flow to produce pulses. A switching circuit could also switch polarity of the electrodes 20 to 100 times per second to produce a stun effect. For stun effect the potential of battery 62 must be greater than 15 volts. Foam pad 70 cushions the impact and helps stop skin penetration by the housing.

FIGS. 8A and 8B show another design. This is a very light weight design which is fired from a standard firearm. The standard 9 mm casing 1 propels the stun bullet forward when primer 4 is detonated. Ridges 92 and 92'on the rear portion of tips 88 and 88', interact with ring connectors 84 and 84' to hold the electrode shafts in housing 90 while under acceleration. In flight support 87 keeps centrifugal forces from bending the back portions of electrode shafts 86 and 86' outward. On impact foam rubber pad 94 interacts with the clothing 74 of the target bringing housing 90 to a stop. The momentum stored in the mass of the electrodes 86 and 86', and support 87 causes the electrodes to continue moving forward. Electrode tips 88 and 88' are forced down angled channels 91 and 9' and outward at an angle. The electrode tips then penetrate clothing 74, skin 76, and tissue 78. Channels 91 and 9' are also angled slightly in the direction of rotation (not shown), which helps prevent the housing from continued rotation after impact. As shafts 86 and 86' reach their full deployment cone connectors 85 and 85' wedges itself into ring connectors 84 and 84' to complete the electric circuit. Current then flows from battery 80 though shafts 86 and 86', and the targets tissue 78. Support 87 also helps stop forward motion of shafts 86 and 86' so that they are not forced beyond ring connectors 84 and 84'.

FIG. 11 shows yet another stun bullet design. When being fired, right wire 132 is held in place by interaction between electrode tip 138, and ridge 136 with indention 148, and ridge 150 respectfully. The left wire and electrode tip has a similar indention (not shown) on the back side of housing 140. After leaving the gun barrel, wire 132 (left electrode has identical operation as right electrode which is labeled) uncoils from around spindle 144. Wire 132 is much stiffer than that used in the design shown in FIGS. 1 through 3, and spring tension in the wires force them to uncoil. The entire system then rotates as a unit. Tail fins 146 help stabilize the bullet as does the rearward angled nature of wire 132. Electrode tip 138 is slightly weighted to help keep it pointing forward against wind drag. Wire 132 is bent at angle 134 such that the stiffness of the wire helps keep tip 138 pointing forward. On impact rubber tip 142 absorbs shock, and spreads to prevent penetration. Momentum of electrode tip 138, and wire 132 cause tip 138 to bend forward and penetrate into the target. Ridge 136, and off center entry angles help hold the electrodes in place while electric current is passed through the target. Electric current is produced by any of a number of methods including those shown in FIGS. 5, 6, and 9.

Summary, Ramifications, and Scope

The stun bullet designs disclosed here have the advantage of extremely small size so that they can be used in standard firearms. Their small size also means that large numbers can be carried. The stun bullet is delivered to the target at high speed which gives the bullet good range and accuracy. Also, because of the electrical nature of the bullet, a hit on the arm or leg will still incapacitate the target, where a normal lead bullet would not. The use of lower voltages, chip level electronics, or defibrillating pulses also separates this design from other devices.

Although the above description of the invention contains many specifications, these should not be viewed as limiting the scope of the invention. Instead, the above description should be considered illustrations of some of the presently preferred embodiments of this invention. For example, any number of alternative dart designs are possible, ranging from small to large, with tail fins and without, single point or multiple point. Instead of wires to extend the electrodes, stiff mechanical methods could be employed. The darts can also be made shorter so that they fit within the length of the stun bullet housing. Also, a shorter dart would penetrate less into the target, and thus less likely to hit bone. The electronics can also be modified in many ways. Capacitor(s) could be used in place of the battery-transformer-capacitor combination. Using high energy-density capacitors to store energy, the bullet would be charged just prior to firing. Multiple voltage capacitors could also be used, with a high voltage capacitor pulse breaking down the nerve sheaths and then quickly followed by a lower voltage current from a lower voltage capacitor. Electric potentials of 200 volts could be produced with solid-state step-up switching-regulators. Since 100 volts is near maximum sustainable potential for silicon, to reach 200 volts would require two isolated switching-regulators, one producing minus 100 volts, and the other plus 100 volts. The two regulators would have a common ground so that neither would experience more than 100 volts, but would output 200 volts when combined in series. Multiple floating switching-regulators could be combined to produce even higher voltages, with each regulator having its own battery or isolation circuitry. The stun bullets flight characteristics could also be modified in several ways. For example, the wires connecting the stun bullet housing with the electrodes need not maintain housing alignment. Instead, with wires positioned on the front and rear of the housing, the housing section would turn sideways, thus presenting a larger frontal cross section, and thereby reducing penetrating ability. The stun bullet could also be used is a stun grenade configuration, where a few dozen stun bullets would be packed around an explosive charge. When detonated the stun bullets would be propelled outward in every direction deploying their electrodes. Other methods of slowing the rate of rotation of a stun bullet also exist. Angled vanes on the sides of the stun bullet housing would create a counter rotating force from interaction with the airflow. This counter force would slow the rotation of the housing. Thus, the scope of this invention should not be limited to the above examples, but should be determined from the following claims.

I claim:

1. An electronic projectile, comprising:

(a) an electric potential means having a positive pole and a negative pole for supplying an electric current;

(b) a plurality of electrodes each having at least one sharp tip for piercing the skin and clothing of a target;

(c) a housing enclosing said electric potential means; and (d) a plurality of elongated members, each elongated member connecting each electrode to said housing, and electrically connecting each of said positive and negative poles to at least one electrode, and said elongated members having a retracted position with the electrodes adjacent to said housing before firing and an extended position with the electrodes expanded laterally away from the housing after firing and before impact.

2.The electronic projectile in claim 1, wherein:

said electric potential means provides a series of electric pulses sufficient to incapacitate said target.

3. The electronic projectile in claim 2, wherein:

said electric potential means further providing a defibrillating pulse a few seconds after said series of stun pulses, whereby the danger of death by heart fibrillation to said target is substantially reduced.

4. The electronic projectile in claim 1, wherein:

said plurality of electrodes use the linear momentum of the electrodes to provide the force needed to puncture the skin and clothing of the target with said sharp tip.

5. The electronic projectile in claim 4, further including:

a means for providing a holding force between said plurality of electrodes and said target's skin or tissue.

6. The electronic projectile in claim 5, wherein:

said plurality of electrodes are attached to said housing by wires, which extend the electrodes away from said housing before impact with the target.

7. A bullet for use in a firearm with barrel rifling, comprising:

(a) an electric potential means having a positive pole and a negative pole for supplying an electric current sufficient to deter a person or animal;

(b) a plurality of electrodes each having at least one sharp point, whereby the electrodes can puncture a persons or animals skin;

(c) a housing having a radial dimension and a longitudinal dimension substantially enclosing said electric potential means and said electrodes placed adjacent to said housing before firing; and (d) a plurality of elongated members, each elongated member connecting each electrode to said housing elongated members electrically connecting each of said positive and negative poles to at least one electrode and said electrodes expanded in the radial dimension by the elongated members after firing and before impact whereby the distance between electrodes on impact is greater than the distance between electrodes before firing.

8. The bullet in claim 7, wherein:

said elongated members are provided by a plurality of wires, said plurality of wires being wound on the housing in the direction counter to the direction of rotation and able to unwind due to centrifugal forces on the electrodes, whereby as the electrodes extend out and away from housing the rotational momentum within said housing is substantially transferred to the electrodes.

9. The bullet in claim 7, wherein:

said plurality of electrodes use the linear momentum of the electrodes to provide the force needed to puncture the skin and clothing of said person or animal with said sharp point.

10. The bullet in claim 7, further including:

a means for providing a holding force between said plurality of electrodes and the skin or tissue of said person or animal.

11. The electronic bullet in claim 7, wherein:

said elongated members having sufficient spring tension to extend the electrodes out and away from said housing against air drag and rotational forces.

* * * * *